US007207446B1

(12) United States Patent
Boston

(10) Patent No.: US 7,207,446 B1
(45) Date of Patent: Apr. 24, 2007

(54) DETACHABLE GOLF BALL DISPLAY

(76) Inventor: Jason Paul Boston, 1234 Aspen St., Broomfield, CO (US) 80020

( * ) Notice: Subject to any disclaimer, the term of this patent is extended or adjusted under 35 U.S.C. 154(b) by 160 days.

(21) Appl. No.: 10/917,625

(22) Filed: Aug. 13, 2004

(51) Int. Cl.
*A47F 7/00* (2006.01)

(52) U.S. Cl. ..... 211/14; 211/71.01

(58) Field of Classification Search ..... 211/14, 211/75, 74; 63/15.1, 15.5, 12, 15.45, 15.65
See application file for complete search history.

(56) References Cited

U.S. PATENT DOCUMENTS 1,389,984 A * 9/1921 Reed ..... 211/74
D242,646 S * 12/1976 Shorin et al. ..... D11/2
4,955,485 A * 9/1990 Alton ..... 211/14
5,165,538 A * 11/1992 Peters ..... 206/315.9
5,195,633 A 3/1993 Kaminski
D342,740 S * 12/1993 Parker ..... D14/218
D353,283 S * 12/1994 Ford ..... D6/449
5,655,673 A * 8/1997 Weterrings et al. ..... 211/75
5,746,332 A * 5/1998 Kleinschmidt ..... 211/153
D397,897 S 9/1998 Tipton
D411,131 S * 6/1999 Chen ..... D11/27
6,562,423 B2 * 5/2003 Rubin ..... 428/13

OTHER PUBLICATIONS http://ffden-2.phys.uaf.edu/211_fall2002.web.dir/josh_fritts/ball.html; The Physics of Golf, Nov. 16th, 2002, World Wide Web, pp. 1-2.*

* cited by examiner

*Primary Examiner*—Jerry Redman
*Assistant Examiner*—Colleen M. Quinn
(74) *Attorney, Agent, or Firm*—Merchant & Gould P.C.

(57) ABSTRACT

A golf ball display includes a display plate having a display field that includes information relating to a commemorative golf ball, and a bracket attached to the display plate for detachably securing the display plate to the commemorative golf ball. The display plate is sized to be largely hidden behind the commemorative golf ball when the golf ball is viewed head-on. The bracket that secures the display plate to the golf ball defines a curved inner surface having a diameter substantially equal to the diameter of a golf ball and a length dimension that is greater than one half of the circumference of a golf ball. The display plate may be separately engraved or may be affixed with a data label that includes information associated with the commemorative golf ball such as a location of the golf course, a date that golf game was played, a player's score, and a subjective rating of the golf course. The labels may be printed by a computer located at a golf course or may be separately printed using a personal computer.

5 Claims, 8 Drawing Sheets

DETACHABLE GOLF BALL DISPLAY

TECHNICAL FIELD

The invention relates generally to a detachable golf ball display and, more particularly, to an apparatus that may be attached to a commemorative golf ball (such as a logo ball) to provide an informational display relating to the golf ball.

BACKGROUND OF THE INVENTION

Golf is a uniquely challenging sport that can create many memorable days (both good and bad) for professional and amateur players alike. Avid golfers often tend to collect golf balls to commemorate special events such as playing on a famous or particularly challenging golf course, or hitting a particularly difficult shot such as a hole-in-one. Other golf balls may commemorate a victory, either individually or as part of a team in tournament play. In many instances, a golfer may simply wish to keep a "logo ball" as a souvenir of a particular golf outing or a particular golf course. Such logo balls often include a decoration and/or the name of a particular golf course or tournament.

Once a golfer has collected a number of distinctive balls (e.g., logo balls), he or she may wish to display the golf balls on a decorative rack having a number of shelves containing depressions within which the balls sit. U.S. Pat. No. D397,897 issued to Tipton provides one example of such a display rack (shaped like a golf ball on a tee) having a number of shelves with depressions for holding a plurality of commemorative golf balls. While such display racks provide for displaying a large number of logo (or other special) golf balls, the display racks do not provide any means for identifying the golf ball beyond the logo or other information that is actually printed on the ball itself. For example, display racks of the type shown in U.S. Pat.No. D397,897 provide no distinctive information for the golf balls displayed on the shelves. Thus, anyone viewing the golf balls in the display would be unable to discern any important details relating to the golf ball beyond the information that can be gleaned from the logo on the ball. For example, casual inspection of a golf ball within the display would not provide any information relating to the significance of the ball, such as the score associated with the round of golf or the date that the round was played. Indeed, even the golfer who kept the commemorative golf ball and placed it in the display may tend to forget the details or import of an individual golf ball as the collection of commemorative balls grows in size.

One solution to the above problem is to mount each commemorative golf ball on a separate plaque where pertinent information (such as score, date and other significant details) may be engraved or otherwise printed on the plaque. However, such individual displays are prohibitively expensive and can consume excessive amounts of space relative to the type of display rack described in U.S. Pat. No. D397,897. Another solution would be to place relevant identifying information directly on the golf ball itself (such as by writing on the golf ball with permanent ink), although this solution is not popular since most golfers prefer not to mar their commemorative logo balls.

Thus, an improved display mechanism is needed that will allow a golfer to simultaneously display a commemorative golf ball (such as a logo ball) while providing pertinent data or information regarding the significance of the golf ball. Such a display mechanism would preferably be selectively attachable to and detachable from a logo ball so that the ball could be viewed or examined separately from the display mechanism. Furthermore, the display mechanism should be of a size and shape that allows use of the display mechanism with conventional golf ball displays such as the display rack shown in U.S. Pat. No. D397,897 described above. It is with respect to these and other background considerations, limitations and problems that the present invention has evolved.

SUMMARY OF THE INVENTION

In accordance with the present invention, the above and other problems are solved by a detachable golf ball display that includes a display plate having a display field that includes information relating to a commemorative golf ball, and a bracket attached to the display plate for detachably securing the display plate to the commemorative golf ball. Although the display plate may take a variety of different shapes, a substantially round shape is preferred so that the display plate can be largely hidden behind the commemorative golf ball when the golf ball is viewed head-on. In one preferred embodiment, a bottom portion of the substantially round display plate includes a flat bottom edge that is useful for supporting the display and attached golf ball on a flat surface or for providing clearance when the golf ball is seated within a depressed portion of a golf ball display. Additionally, while the detachable golf ball display may be formed from a variety of materials, a preferred embodiment is constructed from plastic where the display plate and the bracket are formed integrally as a single molded piece. In this preferred embodiment, a data label is preferably attached to the display field of the display plate wherein the data label includes information associated with the commemorative golf ball such as a location of the golf course, a date that golf game was played and a player's score. In one embodiment, the bracket defines a curved inner surface having a diameter substantially equal to the diameter of a golf ball and a length dimension that is greater than one half of the circumference of a golf ball. Indeed, the curved inner surface of the bracket may include two opposing curved arms that flex outwardly to receive the golf ball.

In accordance with another embodiment of the present invention, a detachable golf ball display includes a display means for displaying information relating to a commemorative golf ball and an attachment means for detachably securing the display means to the commemorative golf ball.

In a further embodiment of the present invention, a method of associating relevant information with a commemorative golf ball comprising the steps of recording the relevant information on a display plate and detachably securing the display plate to the golf ball. The relevant information recorded on the display plate may include a date when a golf game was played, a score of the golf game, a location of the golf course, names of other players that played the golf course, color of tees played, rating of the golf course, slope of the golf course, notable events including birdies, eagles and holes-in-one, temperature on the golf course and other notable weather conditions experienced, and a subjective rating of the golf course. In one embodiment, the step of recording the information on the display plate may include printing the information on a label and then affixing the label on the display plate. The labels may be printed by a computer located at a golf course, such as a GHIN computer, or the labels may be printed by individual golfers using a personal computer. Alternatively, a third party may be employed to generate the labels and send the entire detachable golf ball display to an individual.

These and various other features as well as advantages, which characterize the present invention, will be apparent from a reading of the following detailed description and a review of the associated drawings.

BRIEF DESCRIPTION OF THE DRAWINGS

FIG. 2B is an elevated front view of the golf ball display rack shown in FIG. 2A illustrating that the golf balls positioned on the rack comprise "logo" golf balls (labeled A–P), and further illustrating that the detachable golf ball displays of the present invention are substantially hidden from view when the logo balls are viewed head-on.

DETAILED DESCRIPTION

Figure 1:
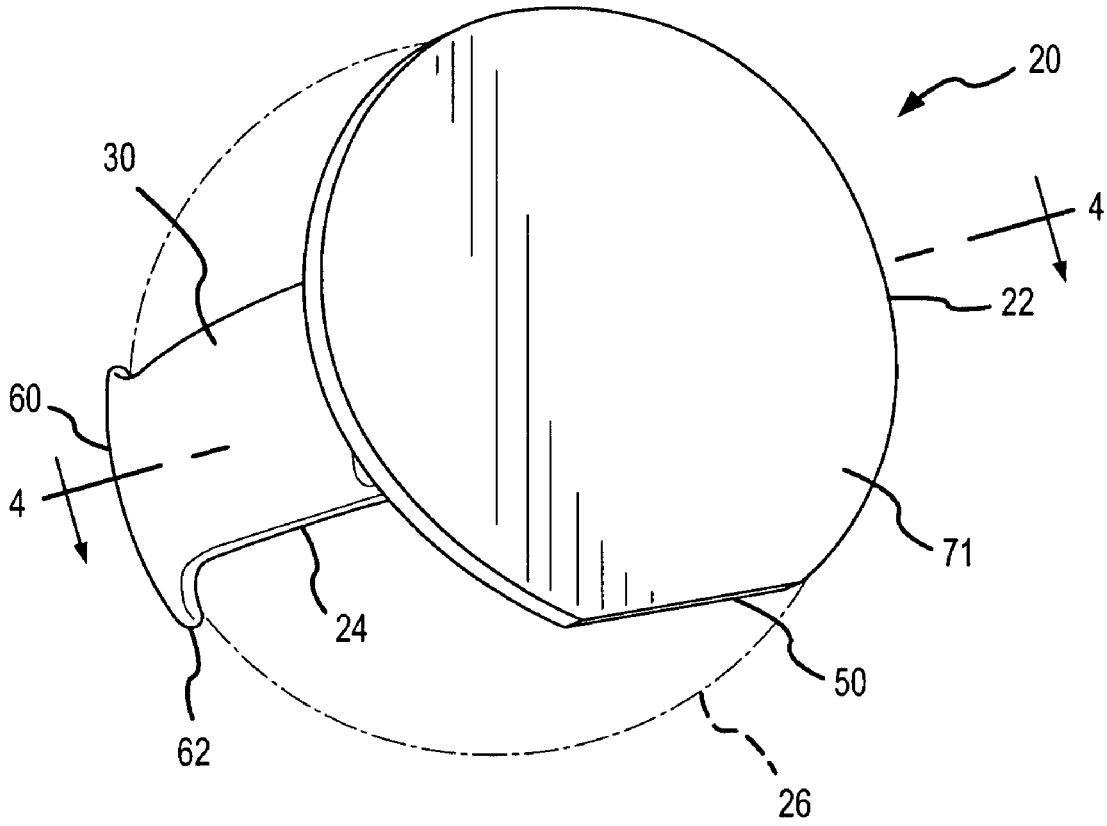
FIG. 1 is an isometric view of a detachable golf ball display in accordance with an embodiment of the present invention, where the golf ball display is shown attached to a phantom golf ball.

FIG. 1 illustrates an exemplary detachable golf ball display 20 in accordance with one preferred embodiment of the present invention. Specifically, the detachable golf ball display 20 comprises a display plate 22 and an attachment bracket 24 for grasping a golf ball 26 (shown in phantom). In a preferred embodiment, the display plate 22 is substantially round in shape with a diameter that is slightly less than the diameter of a standard golf ball (i.e., approximately 1.5 to 1.6 inches when used with golf balls having a 1.68 inch diameter). While alternative shapes may be used with the present invention, the substantially round shape is preferred since it serves to maximize the display area while also allowing the display plate 22 to remain substantially hidden from view as described with respect to FIG. 2 below.

Figure 3:
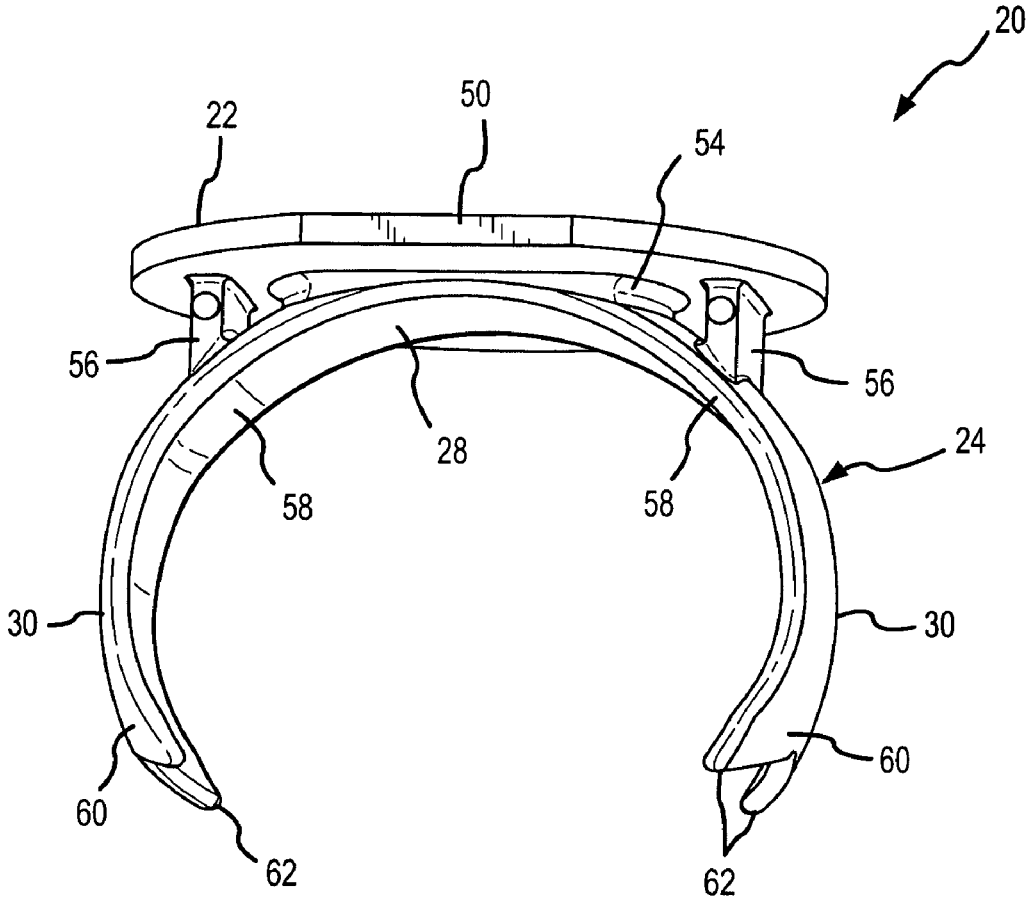
FIG. 3 is an enlarged isometric view of the detachable golf ball display shown in FIG. 1 illustrating that the display comprises an informational display plate attached to a curved gripping bracket, and further illustrating a flat bottom edge of the informational display plate utilized in one embodiment of the present invention.
Figure 4:
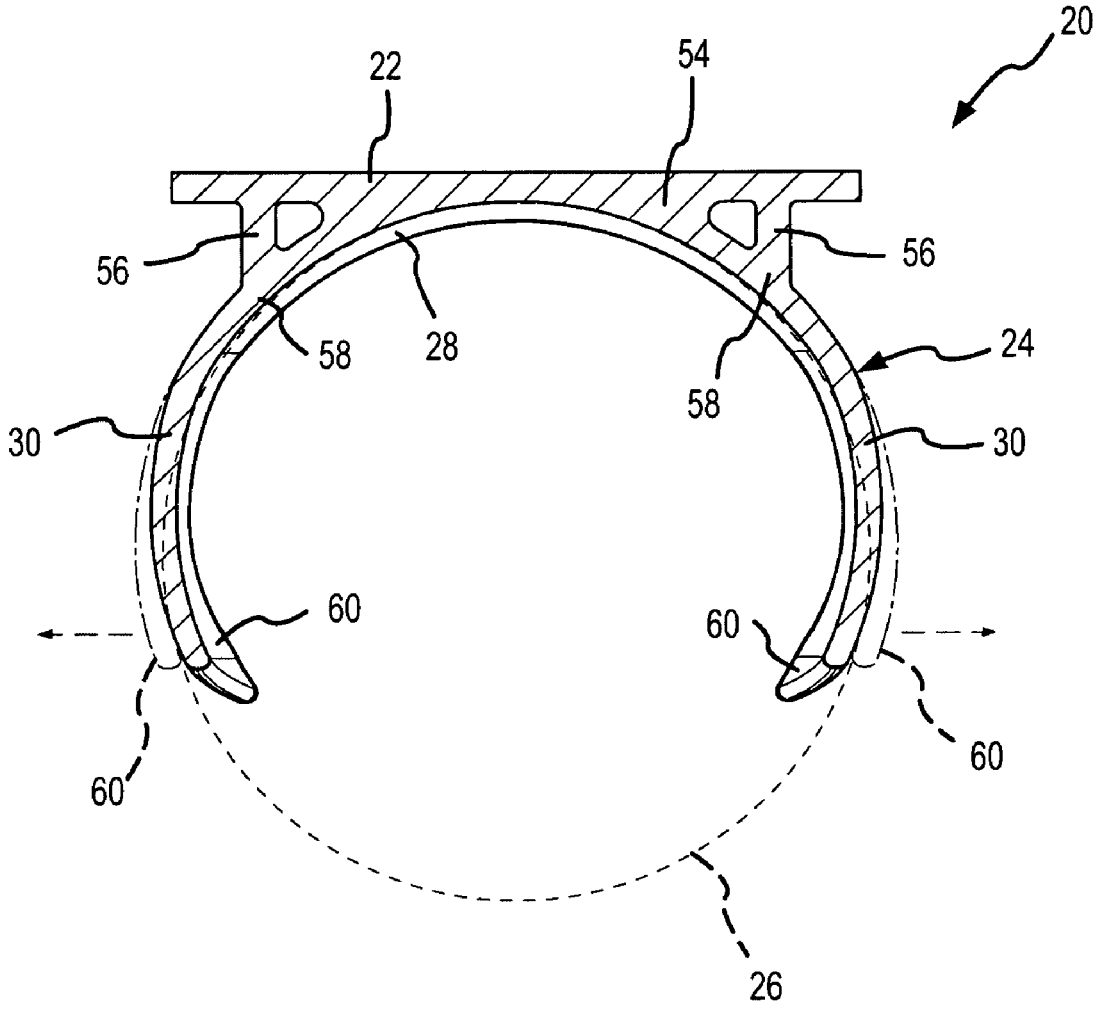
FIG. 4 is a section view of the detachable golf ball display taken substantially along the line 4—4 in FIG. 1, wherein opposing arms of the curved gripping bracket are shown in a first position prior to attachment to a golf ball and a second flexed position (shown in phantom) to accommodate a golf ball (shown in phantom).

The attachment bracket 24 preferably defines a curved inner surface 28 (FIG. 3) having a diameter substantially equal to the diameter of a golf ball 26 for grasping the golf ball as described in greater detail below. In one embodiment, the curved inner surface 28 is defined by opposing curved arms 30 as shown in FIGS. 3 and 4 below. However, the shape of the attachment bracket 24 may be varied by those skilled in the art without departing from the scope of the present invention.

Figure 2A:
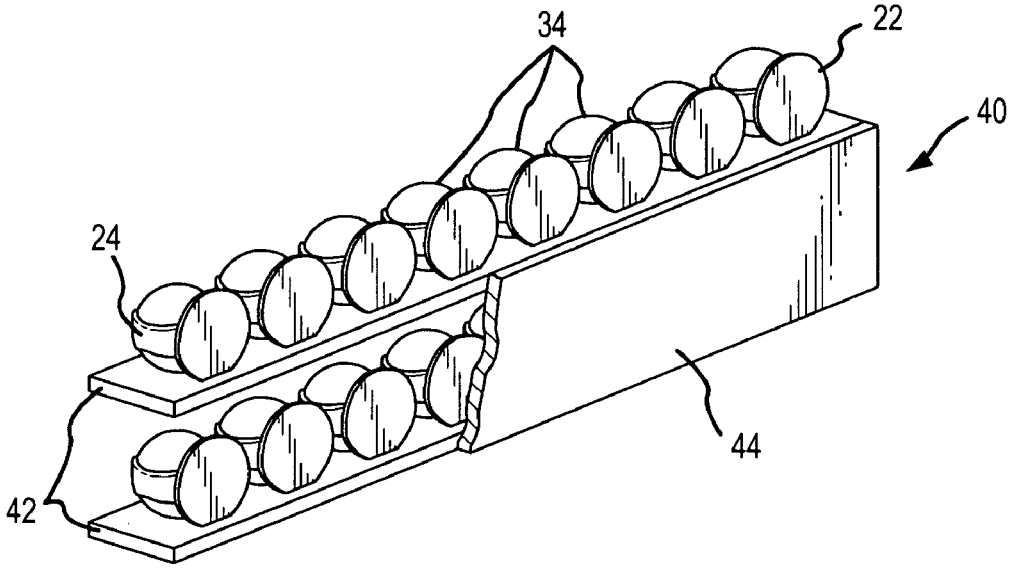
FIG. 2A is an isometric view of a rear portion of a golf ball display rack (with a portion broken away) illustrating a plurality of golf balls arranged on two shelves, where a separate detachable golf ball display as shown in FIG. 1 is attached to a rear portion of each golf ball.
Figure 2B:
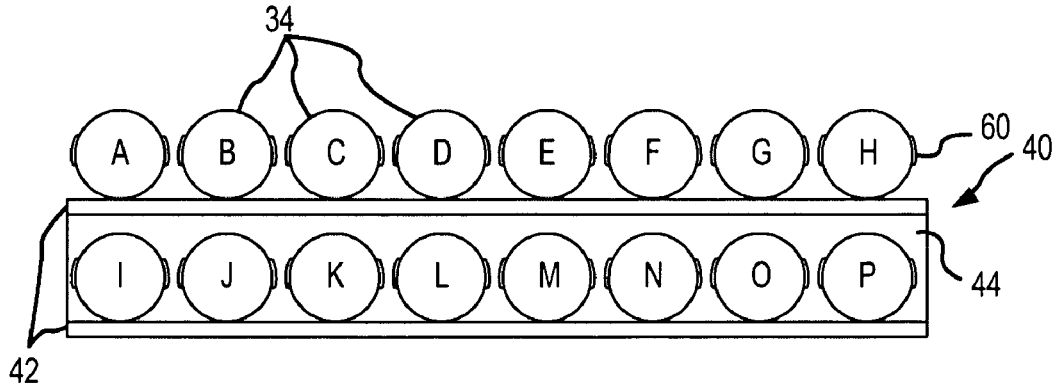
Figure 2C:
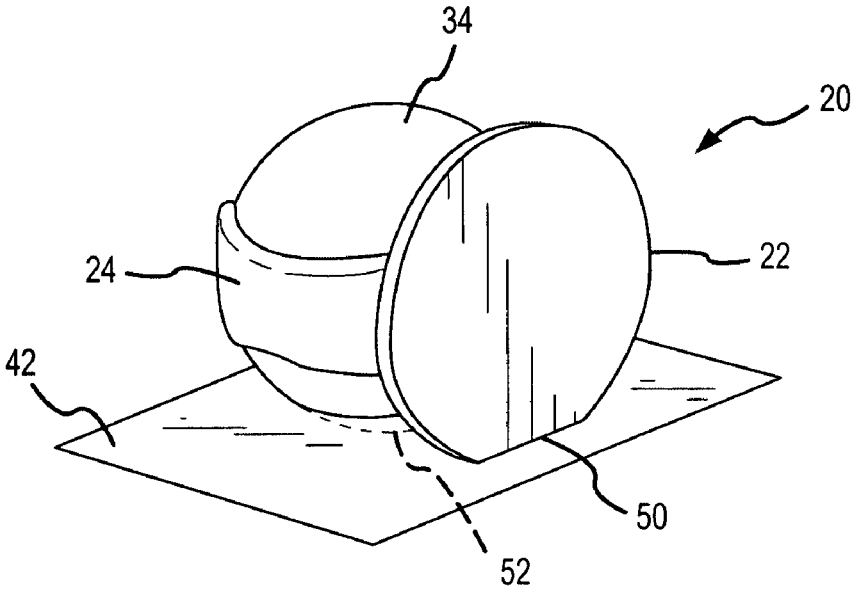
FIG. 2C is an enlarged isometric view of a single golf ball and an attached golf ball display on the display rack shown in FIG. 2A, and further illustrating that the detachable golf ball display in accordance with an embodiment of the present invention includes a flat bottom edge to accommodate placement of the golf ball in a depression (shown in phantom) on the display rack.

FIGS. 2A–2C illustrate one exemplary use of the detachable golf ball display 20 in accordance with a preferred embodiment of the present invention. Specifically, when a golfer desires to display a plurality of "logo" (or other commemorative) golf balls 34 on a conventional display rack 40, each ball 34 may include a separate detachable golf ball display 20 arranged so that the display plate 22 is opposite the golf ball logo (e.g., the logos "A" to "P" in FIG. 2B). For example, FIG. 2A shows that the display rack 40 includes two shelves 42 supported by a rear wall 44 (shown partially broken away in FIG. 2A). Each shelf 42 typically includes dimples or depressions for holding a plurality of logo balls 34 (e.g., 8 balls are shown on each shelf in FIGS. 2A and 2B).

The logo balls 34 are typically arranged with their logos (e.g., the letters "A" to "P") facing outward away from the rear wall 44. This arrangement is maintained when the logo balls 34 are used with the detachable golf ball display 20 of the present invention. Specifically, as shown in FIG. 2A, the arms 30 of the attachment bracket 24 are placed on the sides of the logo balls 34 while the display plate 22 is positioned directly opposite the logo itself. When placed in this manner, the display plate 22 is substantially hidden by the diameter of the logo ball 34 when the logo balls are viewed from a position immediately in front of the display rack 40, as shown in FIG. 2B. Indeed, from the vantage point shown in FIG. 2B, only the ends of the curved arms 30 are seen extending around the sides of the logo balls 34 (as explained below, the ends of the arms 30 preferably extend slightly beyond a midpoint of the ball 34 to ensure that an adequate gripping force is applied to the ball 34).

Because the shelves 42 of the display rack 40 typically include recessed regions or seats for each logo ball 34, the display plate 22 preferably includes a flat bottom edge 50 (FIGS. 1 and 2C) so that the bottom edge 50 does not impact a top surface of the shelf 42 when the arms 30 are placed about a midline or equator of the golf ball. In other words, because the logo ball 34 is typically sits within a recess 52 (shown in phantom) on the display shelf 42, the bottom edge 50 of the substantially round display plate 22 provides clearance for the display plate by either resting on the shelf surface or extending slightly above the shelf 42 when the logo ball 34 sits within the recessed region. As described below with respect to FIG. 6A, the flat bottom edge 50 may also be used to help support the ball 34 and prevent it from rolling on a flat surface. Alternatively, the display plate 22 may be formed with a circular shape having no flat bottom edge 50, provided that the diameter of the plate 22 is reduced to avoid contacting the shelf 42 when the logo ball 34 is positioned within the recess. While this alternative embodiment would preserve and even enhance the "invisibility" of the display plate 22 when viewed from the front of the rack 40, it is less desirable than the preferred embodiment that utilizes a larger diameter and a flat bottom edge 50 since the larger diameter provides more usable display space for recording relevant data relating to the logo ball (see FIG. 5 and the respective discussion below).

FIG. 3 illustrates an isometric view taken from below the detachable golf ball display 20. In the preferred embodiment shown in FIG. 3, the golf ball display 20 is preferably formed as a molded plastic piece with multiple attachment points between the display plate 22 and the attachment bracket 24. In particular, a center portion 54 of the bracket 24 is formed integrally with a rear surface of the display plate 22 to provide the primary attachment point between the plate 22 and the bracket 24. Additionally, in a preferred embodiment of the present invention, two stanchions 56 extend to either side of the center portion 54 to help secure the plate 22 to the bracket 24. The stanchions 56 help to anchor a first end 58 of the curved arms 30 when the arms are forced to flex outward when receiving a golf ball 26, as shown in FIG. 4. Thus, the stanchions 56 enhance the stiffness of the arms 30 so that a distal end 60 of each arm 30 is able to apply a higher retaining force against the surface of the golf ball 26 after the arms 30 are spread outward to receive the ball as shown in FIG. 4.

FIG. 3 further shows that each distal end 60 of the curved arms 30 is preferably V-shaped terminating in two relatively sharp points 62, where it is believed that one or more of the points 62 will engage a dimple (not shown) on the surface of the golf ball 26 (shown in phantom), thereby increasing the effective "bite" strength of the distal ends 60 on the surface of the golf ball 26. Of course, alternative shapes for the distal ends 60 are encompassed by the present invention (e.g., the distal ends 60 could narrow to a single point rather than utilize a V-shape with two such points). As a further alternative, the distal ends 60 could simply be squared off or even rounded so that no "bite" points are provided. That is, the relative grip strength of the arms 30 is not vital to the present invention since the grip strength provided by the arms 30 need only be sufficient to prevent the display plate 22 from inadvertently moving relative to the logo on the front of the ball 26.

FIG. 4 illustrates that the curved inner surface 28 of the bracket 24 has a diameter that is substantially equal to that of the golf ball 26 (shown in phantom), wherein the curved inner surface 28 flexes slightly to allow the golf ball 26 to fit within and be at least partially surrounded by the bracket 24. In the embodiment shown in FIG. 4, the curved inner surface 28 of the bracket 24 defines a length dimension that is slightly greater than one-half the circumference of the golf ball 26 so that the ends 60 of the arms 30 provide a secure attachment mechanism for the golf ball 26. Also, as shown by the difference between the solid and phantom lines for the curved arms 30 in FIG. 4, the bracket 24 is preferably formed from a sufficiently flexible material to allow at least a portion of the inner surface 28 (e.g., the arms 30) to flex outwardly in order to receive the golf ball 26. Indeed, the resilient nature of the curved inner surface 28 helps to ensure that an adequate gripping force is applied to the ball 26. Furthermore, as described above, the stanchions 56 help to reinforce a first end 58 of the arms 30, thereby increasing the stiffness and thus the clamping force applied by the arms 30.

While the preferred embodiment of the detachable golf ball display 20 is molded from plastic as described above, the display 20 may also be formed from alternative materials such as metal or even wood for a more refined appearance. Such alternative materials have an additional benefit in that the data displayed on the plate 22 may be engraved rather than printed on a label (as described below with respect to FIG. 5). Additionally, the entire detachable golf ball display 20 may be formed as two pieces attached together rather than a unified structure. For example, the attachment bracket 24 may include a magnet or other attachment means for securely receiving the relatively flat display plate 22, thereby allowing the display plate 22 to be separately engraved or mated with a label and later attached to the bracket 24 when it is desired to secure the display plate 22 to a golf ball 26.

Figure 5:
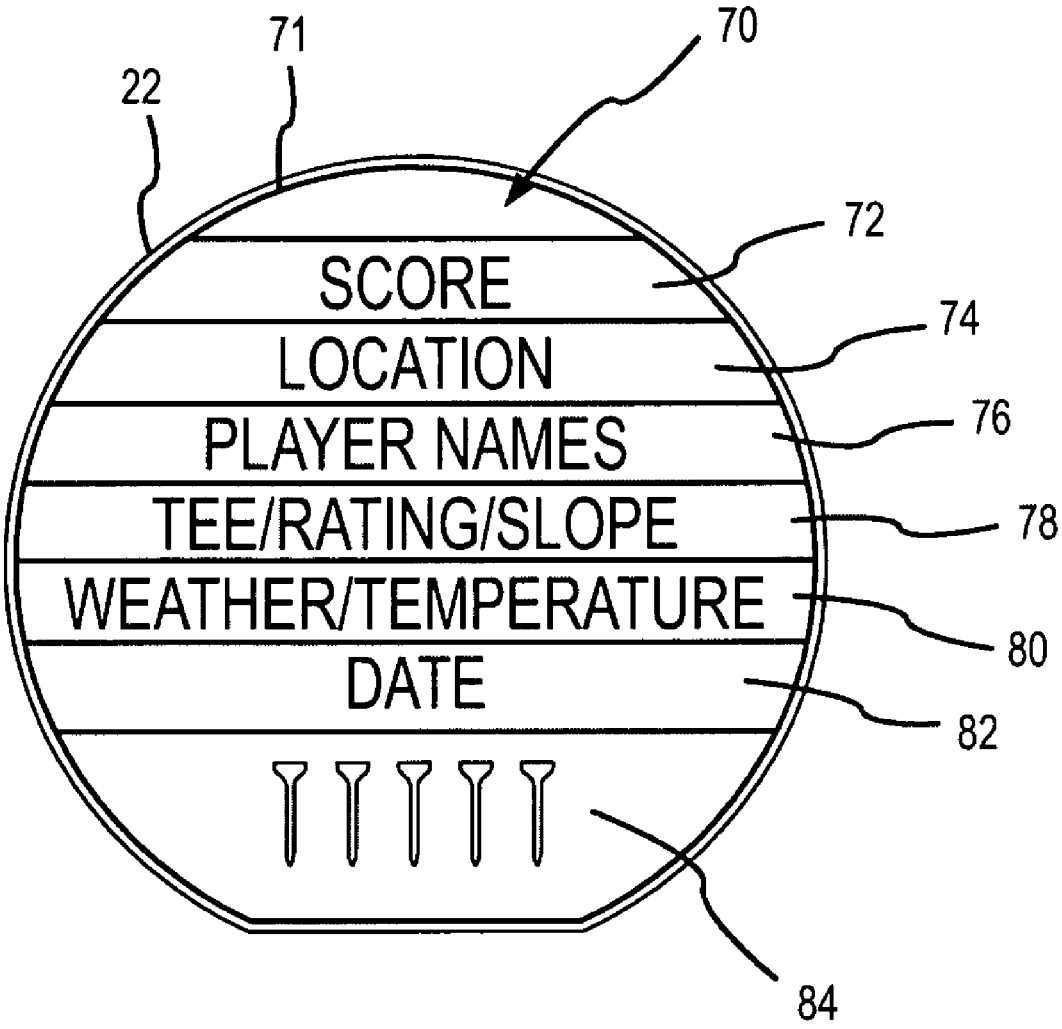
FIG. 5 is an enlarged front view of the display plate of the detachable golf ball display shown in FIG. 1 illustrating an informational sticker attached to the display plate in accordance with one embodiment of the present invention.

FIG. 5 illustrates a data label 70 attached to a front face or display field 71 of the display plate 22. In a preferred embodiment, the label 70 is shaped to match the plate 22, although the label 70 may be replaced by engraving in those instances when the detachable golf ball display 20 is formed from materials other than plastic (e.g., metal or wood). In one preferred embodiment, the label 70 includes a number of different information fields containing data pertaining to the golf course and/or round of golf that is associated with the respective golf ball that will be mated with the detachable golf ball display 20. For example, field 72 includes the score for the round (or perhaps for an entire multi-day tournament), while field 74 details the name and/or location of the golf course played. If it is desired to recount the names of the other players in the group (e.g., up to three additional players in the foursome), those names may be listed in field 76. Additionally, field 78 may be used to denote which tees the golfer played from (e.g., "black" or "blue") as well as other technical information relating to the golf course such as its "rating" and "slope." Field 80 may be used to memorialize other details regarding the temperature or other general weather-related obstacles (e.g., rain or hail) that were encountered during the golf round. Finally, field 82 may be used to denote the date upon which the round was played (or a date range if the display 20 is meant to memorialize a multi-day tournament). A bottom space or field 84 on the label 70 may be used to allow the golfer to provide a subjective rating of the course or his or her performance on the course. For example, FIG. 5 illustrates a "Personal Course Rating" where a golfer may designate a number of "golf tee" icons (similar to a star rating), so that golf courses receiving a higher number of tees would be subjectively ranked above those with a smaller number of tees.

The contents and order of the specific data and other information shown in FIG. 5 is purely representative and it is understood that those skilled in the art may include additional or altogether different information on the label 70 (or on the display plate 22 itself in the absence of a separate label 70). Examples of other types of data that may be applied to the display 20 include greens fees paid, scores on a particular hole (e.g., a birdie, an eagle, or a hole-in-one), front-nine and back-nine scores, course played (for golf courses that include more than one 18-hole course), scores for other players in the foursome, etc.

In those cases where a label 70 is to be applied to the display plate 22 of a detachable golf ball display 20, there are a variety of different methods that may be utilized to obtain and print the data on the label 70. First, in those instances where a golf course pro shop elects to provide a player with a commemorative golf ball and detachable display 20, the golf course may print the label from information provided by the golfer. Indeed, much of this information would have already been collected by the golf course through their reservation system, so that only the player's score (including tees played) and subjective evaluation would need to be provided prior to printing the label. Alternatively, many golf course pro shops utilize GHIN ("Golf Handicap and Information Network") computers to allow players to post scores, calculate handicaps and retrieve handicap information online. These computers could be updated to include label printing software so that golfers could print their own labels after inputting the relevant information. As a further alternative, individuals could purchase their own supply of detachable displays 20 and a supply of pre-printed labels 70 and either print the information on the label by hand or utilize specialized software (or an Internet-based printing service) and a personal computer to print the data onto a die-cut label. Thus, the label 70 shown in FIG. 5 may comprise either a substantially blank label suitable for use with a computer printer, or a pre-printed label designating various information fields that may be filled in by an individual golfer without the use of a computer. Regardless of where or how the specific information is actually printed on the label 70, it is apparent that both the detachable golf ball displays 20 and the information labels 70 may be provided together by a business entity (e.g., a golf course or a Web-based entity) that allows for some customization of the information displayed on the label 70.

Figure 6A:
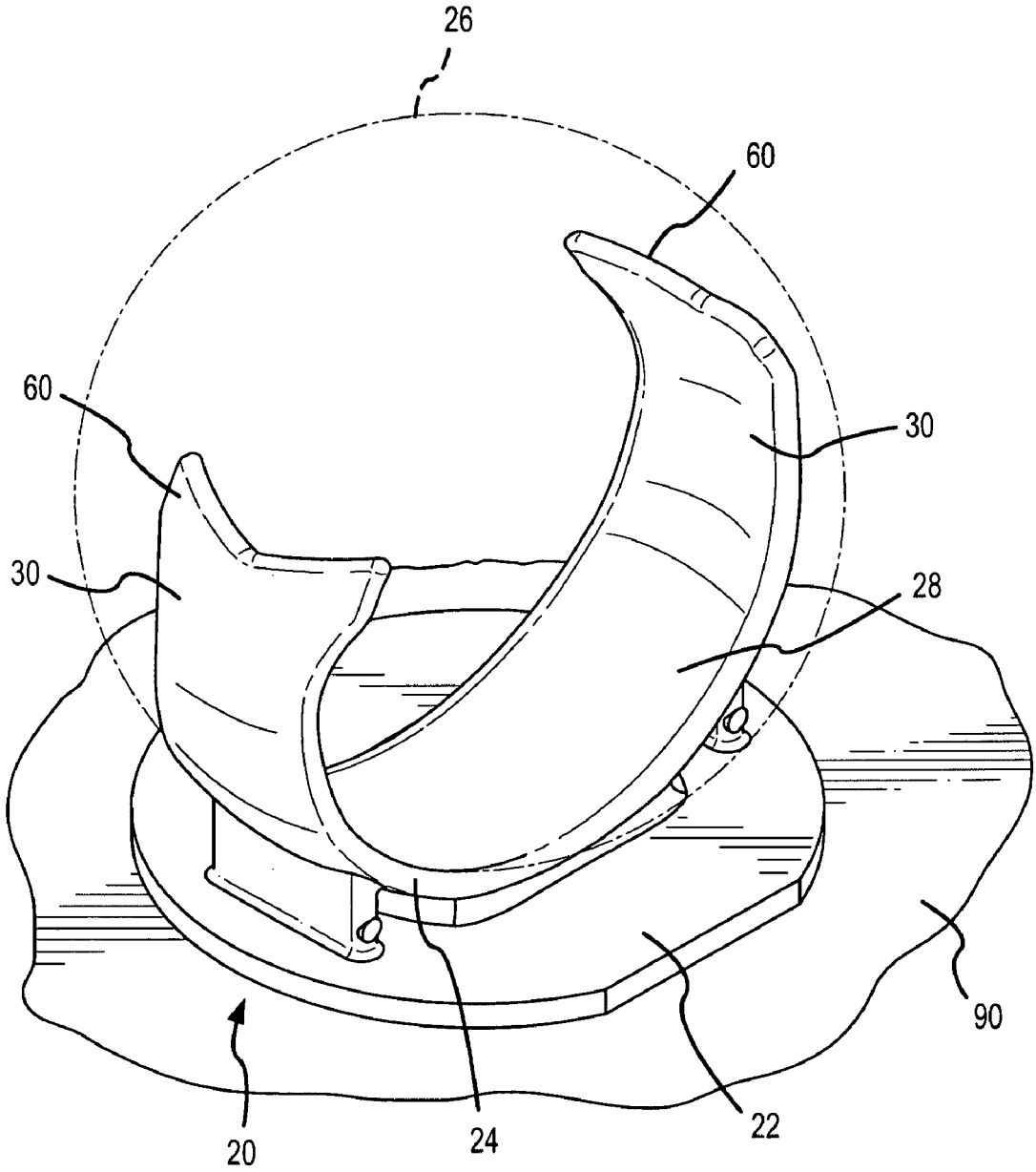
FIG. 6A is an enlarged isometric view of the detachable golf ball display in accordance with an embodiment of the present invention further illustrating that the display plate may support a golf ball (shown in phantom) on a substantially flat surface such as a desk.

While FIGS. 2A–2C have illustrated the detachable golf ball display 20 in a display-only mode (i.e., in conjunction with another display rack 40 used to actually retain the golf balls), it is understood that the displays 20 may also be used to support or position a golf ball 26 separately from the type of display rack 40 shown in FIGS. 2A–2C. For example, FIG. 6A illustrates the same detachable golf ball display 20 in an alternative configuration whereby the golf ball 26 is retained by the curved arms 30 of the bracket 24, and the flat display plate 22 is used to actually support the golf ball on a flat surface 90 such as a desk or a conventional bookshelf. In this manner, the golf ball 26 (shown in phantom in FIG. 6A) may be oriented so that a logo on the golf ball is presented to an observer, wherein the observer would be required to pick up the combination of the golf ball 26 and the detachable display 20 in order to view the relevant data and other information contained on the display field 71 of the display plate 22.

Figure 6B:
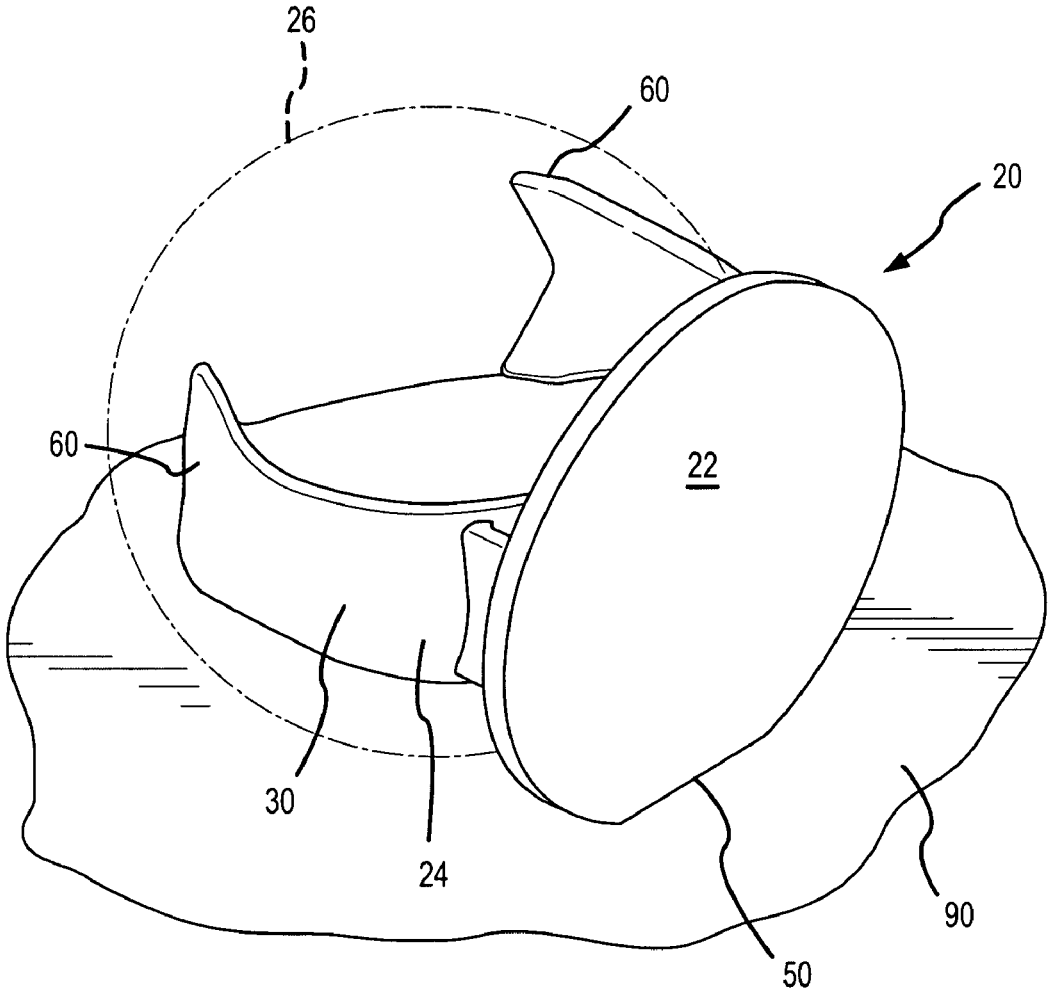
FIG. 6B is an enlarged isometric view of the detachable golf ball display similar to FIG. 6A illustrating an alternative means for displaying a golf ball (shown in phantom) on a substantially flat surface.

FIG. 6B illustrates yet another use for the detachable golf ball display 20 where the ball 26 (shown in phantom) is again displayed on a flat support surface 90 (i.e., a surface without a recess for cradling the golf ball 26). As shown in FIG. 6B, the flat bottom edge 50 of the display plate is used to prevent inadvertent movement or rotation of the golf ball 26. In particular, the bracket 24 and the attached display plate 22 are rotated or tilted slightly downward along a central axis that runs through the golf ball 26 so that a logo on the front of the ball may still be displayed in a centered manner when the flat bottom edge 50 engages the surface 90. In an alternative embodiment, when it is known that detachable golf ball display 20 will be used in the configuration shown in FIG. 6B, the display plate 22 may be rectangular in shape to provide a bottom edge having a greater contact area with the surface 90. Indeed, while a substantially circular shape is preferred for the display plate 22 as noted above, the present invention is not limited to any particular shape for the display plate 22 and a square shape may be preferred in those instances where the golf ball and detachable display 20 will be presented on a flat surface or where a "stealthy" appearance is not otherwise required.

Figure 7:
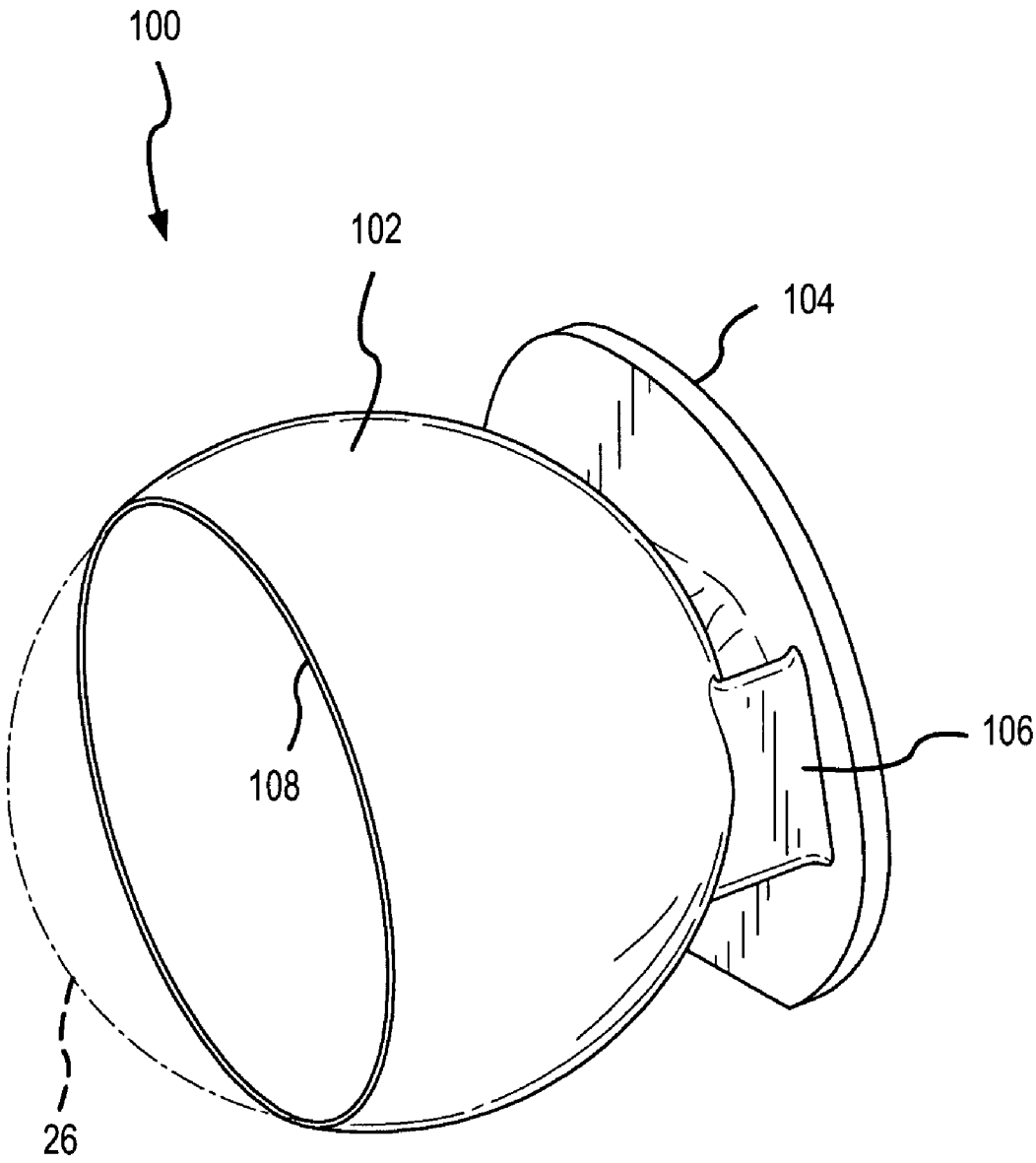
FIG. 7 is an isometric view of an alternative embodiment of the detachable golf ball display of the present invention comprising a cup-shaped bracket for selectively attaching the golf ball (shown in phantom) to the display plate.

In addition to providing different shapes for the display plate 22 as described above, the present invention is not limited to any particular configuration for the attachment bracket 24. While a single bracket having two curved arms 30 is shown in FIGS. 1–6, it is understood that other types of brackets are encompassed by the present invention and that those skilled in the art may provide a variety of different attachment means for securing the display plate 22 to a golf ball. FIG. 7 illustrates one exemplary alternative embodiment of a detachable golf ball display 100 where the bracket 24 used with the display 20 has been replaced by a solid, substantially hemispherical cup 102 attached to a respective display plate 104. In the example shown, which example is not intended to limit the scope of the invention, the cup 102 is secured to a rear surface of the display plate 104 by two stands 106 (only one of which is shown in FIG. 7). Additionally, the dimensions of the cup 102 are slightly larger than (i.e., extend slightly beyond) the dimensions of a true hemispherical cup so that the cup 102 defines an outer, circular edge 108 having a diameter that is smaller than a diameter of the golf ball 26 (shown in phantom) in order to provide a secure, locking engagement with the golf ball 26.

Regardless of the precise shape or configuration of the detachable golf ball display, the present invention solves the problem of providing context and meaning to large collections of souvenir or commemorative golf balls. By attaching a display (20 or 100) to a golf ball, anyone viewing the golf ball may simply pick up the ball and look at the attached display plate to discern numerous details associated with the golf ball. The displays (20 or 100) are inexpensive to manufacture and may be sold either as a complete item (e.g., by a golf course pro shop) or as a kit along with labels (and/or software for printing the labels) so that individual golfers may utilize a personal computer to customize and print their own detachable golf ball displays. Furthermore, the detachable nature of the displays allows a golfer to remove the display from a commemorative golf ball if the need should arise, such as when the golfer decides to give the logo ball to another or when the display is damaged so that a replacement display is required.

It will be clear that the present invention is well adapted to attain the ends and advantages mentioned as well as those inherent therein. While certain preferred embodiments have been described for purposes of this disclosure, various changes and modifications may be made which are well within the scope of the present invention. For example, alternative construction/forming techniques may be used to manufacture the detachable golf ball displays. While a preferred embodiment of the display (20 or 100) is shown as a molded plastic part, other materials and forming techniques may be used provided that the display includes a means for detachably securing a display plate 22 to the golf ball. Additionally, while the display plate 22 has been shown as a substantially round surface in the figures, other shapes may be utilized with the present invention provided that the display plate 22 maintains its ability to reproduce relevant information pertaining to the commemorative golf ball. Furthermore, a "high-end" display may be formed from materials such as wood or metal so that the display plate 22 can be engraved as opposed to simply providing a surface for the application of a label 70. Numerous other changes may be made which will readily suggest themselves to those skilled in the art and which are encompassed in the scope of the invention disclosed and as defined in the appended claims.

What is claimed is:

1. A golf ball display comprising:

a golf ball having a diameter of approximately 1.68 inches;

an attachment bracket having opposing curved arms that that extend around a portion of the golf ball without encompassing the entire golf ball, wherein the attachment bracket defines a curved inner surface having a length dimension greater than one half of a circumference of the golf ball, and wherein distal ends of the opposing arms are separated by a predetermined gap that is less than the diameter of the golf ball; and a flat display plate extending from a curved outer surface of the attachment bracket opposite the gap defined by the curved arms, the display plate defining a flat bottom edge and a display field that provides information relating to the golf ball.

2. A golf ball display as defined in claim 1 wherein the opposing curved arms of the attachment bracket are formed from a flexible material to allow the distal ends of the curved arms to flex outwardly and receive the golf ball.

3. A golf ball display as defined in claim 1 wherein the display plate is substantially round in shape, and wherein a diameter of the display plate is smaller than the diameter of the golf ball.

4. A golf ball display as defined in claim 3 further comprising a data label attached to the display field of the display plate, wherein the data label has a shape that substantially matches the shape of the display field, and wherein the data label includes information fields relating to the golf ball.

5. A golf ball display as defined in claim 3 wherein the display plate and the bracket are integrally formed together from a flexible material.

* * * * *